United States Patent [19]

Nishino et al.

[11] Patent Number: 4,519,807

[45] Date of Patent: May 28, 1985

[54] CARBONACEOUS SOLID FUEL

[75] Inventors: Atsushi Nishino, Neyagawa; Kunio Kimura; Kazunori Sonetaka, both of Hirakata; Yukiyoshi Iketani, Neyagawa, all of Japan

[73] Assignee: Matsushita Electric Industrial Co., Ltd., Osaka, Japan

[21] Appl. No.: 565,525

[22] Filed: Dec. 28, 1983

Related U.S. Application Data

[63] Continuation of Ser. No. 359,082, Mar. 17, 1982, abandoned.

[51] Int. Cl.[3] ..... C10L 5/02; C10L 9/02

[52] U.S. Cl. ..... 44/15 R; 44/1 R; 44/4; 201/17

[58] Field of Search ..... 44/15 R, 4, 1 R; 201/17

[56] References Cited

U.S. PATENT DOCUMENTS

| | | | |
|---|---|---|---|
| 2,014,686 | 9/1935 | Lubovitch | 44/4 |
| 3,332,755 | 7/1967 | Kukin | 44/4 |
| 3,756,791 | 9/1973 | Mancke | 44/15 R |
| 3,948,617 | 4/1976 | Withorn | 44/4 |
| 4,226,601 | 10/1980 | Smith | 44/15 R |
| 4,302,207 | 11/1981 | Paspek | 44/1 R |

*Primary Examiner*—Delbert E. Gantz
*Assistant Examiner*—Anthony McFarlane
*Attorney, Agent, or Firm*—Wenderoth, Lind & Ponack

[57] ABSTRACT

A molded solid fuel comprises a carbonaceous fuel material, a desulfurizing agent, and $K_2CO_3$ and is effective to emit a reduced amount of sulfur when burned.

4 Claims, 1 Drawing Figure

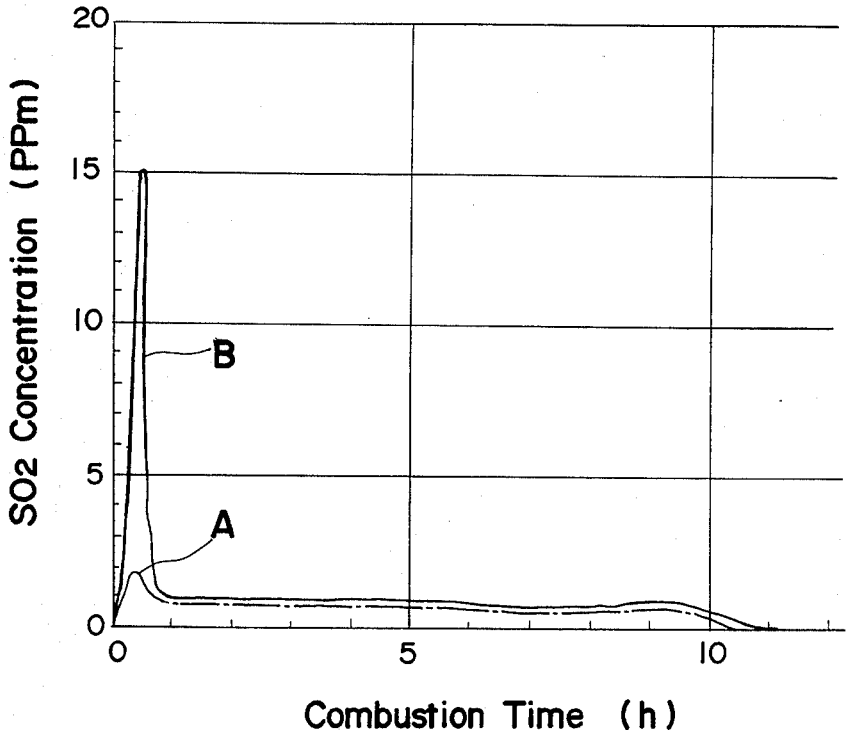
20
15
10
5
0
SO2 Concentration (PPm)
B
A
0
5
10
Combustion Time (h)

CARBONACEOUS SOLID FUEL

This application is a continuation of now abandoned application Ser. No. 359,082, filed 03/17/82 aband.

The present invention generally relates to a solid fuel and, more particularly, to a carbonaceous solid fuel.

With the increasing importance of conservation of oil, an effective utilization of coal has now been called for. Specifically, since both the place of origin of coal and its availability are not limited as compared with those of oil, the coal has gained public attention as a useful fuel substitute for oil. The use of coal as a source of fuel is historically old and, prior to oil being brought into wide use, the coal has long been used as a valuable fuel for domestic use as well as in power plants. Although there are many reasons why oil has superseded the coal as a prime source of fuel, one of them is generally recognized as attributable to exhaust gases emitted by the coal when the latter is burned. As is well known, the coal generally contains sulfur in an amount within the range of 0.2 to 1.0% by weight and this sulfur component is, when the coal is burned, decomposed into sulfur dioxide constituting one of the obnoxious components of the exhaust gases. In view of the problem associated with atmospheric pollution, it is generally recognized as essential to desulfurize the exhaust gases resulting from the combustion of the coal, prior to such exhaust gases being emitted to the atmosphere. In the case of a power plant, desulfurizing equipment is installed and is operated under strict control of skilled attendants to purify the exhaust gases resulting from the combustion of the coal. However, when it comes to briquettes currently available for household use, there is no way other than to allow the briquettes to emit exhaust gases without being desulfurized. Although it appears that such a solid fuel would soon come into wide use in the light of the effective utilization of the coal, it would not be widely accepted unless desulfurizing measures are established.

Attempts to desulfurize the coal have long been carried out, most of which are by way of adding to the coal an alkaline compound such as, for example, calcium hydroxide, iron oxide, magnesia or zinc oxide. Although this desulfurizing agent is effective to some extent, it would not exhibit its desulfurizing effect fully when the temperature at which the combustion takes place is too low or too high and/or when the desulfurizing agent is used in the wrong way.

The present invention has been developed with a view to substantially eliminating the foregoing disadvantages and inconveniences and has for its essential object to provide an improved solid fuel which can be prepared from inexpensive materials and which, when burned, emits a minimized amount of sulfur dioxide.

Another important object of the present invention is to provide an improved solid fuel of the type referred to above which, when burned, emits sulfur dioxide in a minimized amount comparable to that emitted by kerosine.

According to the present invention, a solid fuel is a molded body containing a carbonaceous fuel material, a specific desulfurizing agent and $K_2CO_3$.

These and other objects and features of the present invention will readily become apparent from the following detailed description taken by way of example with reference to the accompanying drawing which shows a graph illustrating change in $SO_2$ concentration with time.

BRIEF DESCRIPTION OF THE DRAWING

The disclosed drawing shows the rate of sulfur dioxide produced in the flue gas for the combustion of fuels with and without gamma-manganese dioxide.

The carbonaceous fuel material utilizable in the practice of the present invention is a natural or synthetic material containing carbon as its principal constituent and includes coal, cokes, charcoal, graphite, activated carbon and the like. Of them, the coal is most inexpensive and readily available because of its abundant reserves. However, the coal is available in some varieties and, of them, anthracite having a carbon content of 90% or more is considered most suitable because it has a minimized volatile component and is substantially free from generation of soot when burned. Among the coal varieties, the anthracite is expensive and is not produced in Japan, and therefore, it may be used in the practice of the present invention, in combination with a popular variety of coal. In addition, if desired, the coal may be mixed with one or more of the other carbonaceous fuel materials such as, for example, cokes, charcoal, graphite and activated carbon for the purpose of improving the ignitability and the moldability.

With respect to the desulfurizing agent, calcium hydroxide is generally used in the currently commercially available briquettes. The calcium hydroxide is, when the briquette is burned, decomposed into CaO which is, after having reacted with oxygen in the air and $SO_2$, generated during the combustion, captured in the form of $CaSO_4$. This $CaSO_4$ is thermally stable and has a high melting point of 1,450° C., but tends to decompose into CaO and $SO_2$ when heated to about 1,250° C. Various metals, when present in the form of sulfates such as $MgSO_4$, $BaSO_4$, $SrSO_4$, $K_2SO_4$ and $Na_2SO_4$, have respective decomposition or melting points of 1,185° C., 1,580° C., 1,580° C., 1,069° C. and 884° C. Judging from these decomposition or melting points, it will readily be seen that salts of any one of calcium and barium are suited as a desulfurizing agent.

The combustion temperature of the briquette is generally about 1,200° C. at maximum although it may vary with the amount of air used during the combustion. In view of this, if the total amount of $SO_2$ generated during the combustion of the briquette is captured with salts of any one of calcium and barium, $SO_2$ should not have been generated. In actuality, however, the desulfurizing power of the calcium salt tends to fall to a value equal to or lower than 50% of the original power when the combustion temperature attains about 1,000° C.

The reason for the above is supposedly that CaO produced upon thermal decomposition undergoes a sintering when heated to a temperature higher than about 1,000° C. and, therefore, becomes chemically inactive to such an extent as to result in reduction of its reactivity with $SO_2$. This is evidenced by the fact that the desulfurizing effect given by any one of $Ca(OH)_2$ and $CaCO_3$ is lower when it is mixed with coal after having been heat-treated at a temperature higher than 1,000° C., than when it is mixed with coal without being burned. In addition, although $Ca(OH)_2$ is said to exhibit a higher desulfurizing effect than $CaCO_3$, this appears to have resulted from the difference in reactivity of CaO produced upon thermal decomposition.

From the foregoing, it may be concluded that the desulfurizing agent must satisfy, amount others, the requirement that no reduction in reactivity takes place even at elevated temperature and that the captured sulfate is thermally stable. From this viewpoint, it is not desirable to use $Ca(0H)_2$, $CaCO_3$ and dolomite ($CaCO_3.MgCO_3$) singly.

The inventors of the present invention have found that the reactivity of this kind of desulfurizing agent at elevated temperature could be remarkably improved when $K_2CO_3$ is added thereto. A sulfate ($K_2SO_4$) resulting from the reaction of $K_2CO_3$ with $SO_2$ has a relatively low melting point of 1,069° C. and, therefore, when used singly, is not thermally stable, and thus hardly satisfies the above described requirements. Accordingly, although $K_2CO_3$ can be used as an effective desulfurizing agent at a lower temperature than 1,000° C., it is rather important to note that $K_2CO_3$ appears to play an additional role in connection with its reaction with any one of CaO and $SO_2$. Although it is not yet certain that the additional role is connected to a calcium salt or the decomposition of the coal, it has been found that the combined use of $Ca(OH)_2$, $CaCO_3$ and dolomite ($CaCO_3.MgCO_3$) gives a synergistic effect to desulfurize at a high rate. Although the desulfurizing effect given by $Ca(OH)_2$, $CaCO_3$ and dolomite when no $K_2CO_3$ is added thereto increases in the order given above, this distinction or rank does not show up when all of $Ca(OH)_2$, the $CaCO_3$ and dolomite are combined and, in fact, the combined use of these compounds gives a highly improved desulfurizing effect. Accordingly, whereas only $Ca(OH)_2$ has long been used as a desulfurizing agent from the viewpoint of its reactivity, inexpensive $CaCO_3$ and dolomite can also be used.

The dolomite referred to hereinabove and hereinafter is an eutectic crystal of $CaCO_3$ and $MgCO_3$, existing in nature in the form of a rock of calcium salt. $K_2CO_3$ is available both in the anhydrous form and in the hydrous form and both can be employed for the purpose of the present invention. The calcium salt may also includes KOH rather than $K_2CO_3$ and this KOH may be employed as a starting material for the purpose of the present invention because this compound is so unstable that it can be transformed into $K_2CO_3$ when it absorbs $CO_2$ in the air during the storage thereof.

The desulfurizing agent which can advantageously be employed in the present invention includes $Ca(OH)_2$, $CaCO_3$ and dolomite and so is limited to these three compounds because of the thermal stability of the resultant sulfate and their inexpensiveness.

Hereinafter, the mixing of the carbonaceous fuel material, specified hereinbefore, with the desulfurizing agent specified above will be discussed. The greater the amount of the desulfurizing agent to be added, the higher the desulfurizing effect. However, an excessive amount of the desulfurizing agent would constitute a cause of reduction of the calories given off by the resultant solid fuel when the latter is burned and, therefore, 20 parts of weight of the desulfurizing agent is preferred relative to 100 parts by weight of the carbonaceous fuel material. Although the desulfurizing agent will exhibit its desulfurizing effect when used in an amount of at least 3 parts by weight or more, 5 parts by weight thereof is preferred as a minimum amount relative to 100 parts by weight of the carbonaceous fuel material. The use of 10 parts by weight or more of the desulfurizing agent would bring about a satisfactory desulfurizing effect, but the maximum amount of the desulfurizing agent to be mixed with 100 parts by weight of the carbonaceous fuel material should not exceed 20 parts by weight in view of the limited particle size of the carbonaceous fuel material which is one of the factors governing the desulfurizing effect.

With respect to the amount of $K_2CO_3$ to be used, it is within the range of 1 to 20 parts by weight relative to 100 parts by weight of the carbonaceous fuel material. If it is smaller than the lowermost limit of 1 part by weight, $K_2CO_3$ when combined with the desulfurizing agent will not give any synergistic effect. On the other hand, if it is greater than the uppermost limit of 20 parts by weight, the resultant solid fuel will tend to swell because of the deliquescent property of $K_2CO_3$. In addition, the amount of $K_2CO_3$ to be actually added is to be determined in consideration of the amount of the desulfurizing agent in such a way that the mixing ratio of the desulfurizing agent and $K_2CO_3$ is preferably within the range of 0.2 to 10. If this ratio is smaller than 0.2, that is, if the amount of the desulfurizing agent is relatively small while that of $K_2CO_3$ is relatively great, although the desulfurizing effect can be obtained at a temperature lower than 1,000° C., it would not be sufficiently appreciated because $K_2SO_4$ tends to decompose at a temperature equal to or higher than 1,000° C. On the other hand, if the ratio is greater than 10, i.e., if the amount of the desulfurizing agent is relatively great while that of $K_2CO_3$ is relatively small, the amount of $K_2CO_3$ will not be sufficient to assure the reaction of the desulfurizing agent and, therefore, will not satisfy the gist of the present invention because the desulfurizing effect may be determined solely by the desulfurizing agent used.

In view of the above, the mixing ratio should be within the range of 0.2 to 10, preferably within the range of 0.3 to 5.

Another important factor that governs the desulfurizing agent is the particle size of each of the carbonaceous fuel material, the desulfurizing agent and $K_2CO_3$. The reaction which takes place between the desulfurizing agent and $SO_2$ which is generated from the carbonaceous fuel material is a gas-solid contact reaction and, therefore, it is desirable to make the desulfurizing agent present around the generated $SO_2$. Accordingly, the greater the particle size of the carbonaceous fuel material, the smaller the occurrence of contact between the desulfurizing agent and $SO_2$ at a location where the latter has been emitted and, therefore, the lower the desulfurizing effect. This notion equally applies to the particle size of any one of the desulfurizing agent and $K_2CO_3$. So far as the desulfurizing agent is concerned, if the particle size thereof is too great, the surface of particles of the desulfurizing agent would be transformed into a sulfate and, therefore, not only can the desulfurizing agent be effectively and efficiently utilized, but also a greater amount of the desulfurizing agent will be required.

In view of the foregoing, the carbonaceous fuel material should have such a particle size that 60% of the total amount of the carbonaceous fuel particles can pass through a 5-mesh Tyler screen which has each mesh opening of 3.962 mm.

From the standpoint of the effective utilization, both the desulfurizing agent and $K_2CO_3$ should be of a particle size smaller than that of the carbonaceous fuel material such that the total amount of particles thereof can pass through the 5-mesh Tyler screen. Eventually it is stated that the use of the carbonaceous fuel material of such a particle size that the total amount thereof can pass through the 5-mesh Tyler screen is rather preferred, but the coal in the form as supplied from the commercial market contains particles of varying particle size, and therefore, the use of the carbonaceous fuel material, at least 60% or more of the total amount of which can pass the 5-mesh Tyler screen, is satisfactory for the purpose of the present invention. Where the amount of the carbonaceous fuel particles that can pass through the 5-mesh Tyler screen does not occupy 60% or more of the total amount thereof used in the practice of the present invention, no improved desulfurizing effect will be appreciated.

With the above described composition of the solid fuel according to the present invention, a sufficiently improved desulfurizing effect can be obtained. However, the solid fuel according to the present invention may contain a transition metal oxide effective to bring about a desulfurizing effect even at a relatively low temperature (not higher than 800° C.) such as occurring at the initial stage of combustion of the solid fuel. This will now be described.

The transition metal oxide which may be used in the practice of the present invention includes oxides of, for example, Cr, Mn, Fe, Co, Ni, Cu and the like.

It is to be noted that, instead of the employment of the transition metal oxide, any one of carbonate and hydroxide may be used as a starting material because it tends to decompose into a metal oxide when burned.

All of these metal oxides have a common feature in that they exhibit not only an excellent oxidization but also a gas absorbing capacity. Among them, it is well known that manganese dioxide is generally used as an $SO_2$ adsorbent. The present invention makes use of these excellent properties of the transition metal oxides and utilizes it in the form as mixed in the solid fuel for the purpose of enhancing the desulfurizing effect at a relatively low temperature. Of the transition metal oxides, oxides of Mn and Cu are preferred because of their performance, inexpensiveness and safety. Especially, $MnO_x$ can exhibit an excellent desulfurizing effect, and $\gamma$-$MnO_2$, a variant of $MnO_x$ which is produced by the use of an electrolysis, is more preferable. These transition metal oxides react with $SO_2$ after having absorbed $SO_2$ and are captured in the form of $MnSO_4$ and $CaSO_4$, respectively. However, these sulfates tend to undergo a thermal decomposition at respective temperatures of about 850° C. and about 650° C. thereby to emit $SO_2$ and, therefore, these metal oxides can not be used singly. Specifically, in the present invention, it is necessary to add the desulfurizing agent capable of being stabilized in the form of a sulfate at the elevated temperature so that $SO_2$ emitted as a result of thermal decomposition of the sulfate can be captured. The second desulfurizing agent for use at the elevated temperature consists of at least one selected from the group consisting of $Ca(OH)_2$, $CaCO_3$ and dolomite ($CaCO_3.MgCO_3$), and $K_2CO_3$ as hereinbefore described. Since this second disulfurizing agent tends to be activated when and after the combustion temperature has attained a value equal to or higher than about 800° C., $SO_2$ emitted as a result of thermal decomposition of the sulfate of the transition metal oxide can advantageously be captured.

While the solid fuel according to the present invention has the composition as hereinbefore fully described, the composition may also include a molding additive where the solid fuel is desired to be molded into a briquette of a generally cylindrical shape or any other suitable shape. The molding additive herein used, although it means a material capable of exhibiting a function that should come out at the time of the solid fuel is to be subjected to a compression molding, should be construed as including a heat-resistant aggregate to be added for the purpose of not only retaining the debris of the solid fuel after the combustion substantially in the original shape, but also avoiding any possible change in combustion condition which would result in when the solid fuel being burned may lose its shape.

The heat-resistant aggregate used for the purpose as described above includes, for example, silica and a naturally occurring or synthesized heat-resistant mineral such as, for example, alumina, silicon carbide, chamotte, mulite, feldspar, agalmatolite, sillimanite, cordierite and the like.

As is well known to those skilled in the art, the combustion of a briquette poses not only the problem associated with the emission of the obnoxious exhaust gases, but also a problem associated with how to deal with the debris of the briquette, that is, how to cause the debris of the briquette to retain a shape generally similar to the original shape thereof. The necessity of the shape retention of the debris of the briquette originates from the necessity of the briquette to undergo a stable combustion without an ash component thereof being scattered, the facilitation of removal of the completely burned briquette and the elimination of the possibility of the ash component thereof adhering to the wall surface of a brazier or stove. In view of this necessity, silica has long been used in the conventional briquette. As is well known to those skilled in the art, silica is inexpensive and readily available and is contained in most of the conventional briquettes of different makes. However, the use of this silica has been found disadvantageous in that it tends to form a glassy material when heated at elevated temperature, by which glassy material the ash component of the briquette burned or being burned is caused to adhere to the wall surface of the brazier or stove.

The inventors of the present invention have made an attempt to add silica to the specific desulfurizing agent as hereinbefore described and have found that, when the silica was used in an amount exceeding a certain amount, the desulfurizing agent used failed to exhibit its desulfurizing effect.

In view of the above, another aspect of the present invention is to provide the solid fuel comprising the carbonaceous fuel material, the desulfurizing agent including a combination of at least one selected from the group consisting of $Ca(OH)_2$, $CaCO_3$ and dolomite and $K_2CO_3$, and at least one heat-resistant filler selected from the group consisting of $MgAl_2O_4$ and $ZrO_2$, wherein the amount of the silica-containing compound is specified.

Hereinafter, the necessity of specifying the amount of silica to be used in the present invention will be described. As is well known to those skilled in the art, silica is an important component for use in the manufacture of glass and forms a variety of compounds when combined with alkaline metals. For example, silica forms $K_2O.4SiO_2$, $K_2O.2SiO_2$ and $K_2O.SiO_2$ when combined with potassium at 770° C., 1,040° C. and 976° C., respectively. Accordingly, it will readily be seen that silica reacts with $K_2CO_3$, which is a component forming the desulfurizing agent used in the present invention, at a temperature approximating the temperatures described above and $K_2CO_3$ effective to desulfurize is therefore consumed in the reaction with $SiO_2$. Therefore, the freedom of use of the silica in the practice of the present invention is limited.

A series of experiments conducted by the inventors of the present invention have revealed that the amount of $SiO_2$ to be used in the present invention must be 10 parts by weight or less relative to 100 parts be weight of the carbonaceous fuel material when the amount of the desulfurizing agent such as $Ca(OH)_2$ used and the amount of $K_2CO_3$ used are respectively within the range of 3 to 20 parts by weight and within the range of 1 to 20 parts by weight relative to 100 parts by weight of the carbonaceous fuel material. If the amount of $SiO_2$ exceeds the maximum allowable amount of 10 parts by weight, the desulfurizing agent will lose its effect by the reason which has hereinbefore been described.

It is, however, to be noted that, even though the amount of $SiO_2$ to be used is specified in the manner as hereinbefore discussed, and when the solid fuel is prepared by the use of the calcium oxide, $K_2CO_3$ and $SiO_2$ in addition to the carbonaceous fuel material, these oxides when melted tend to form a glassy material to such an extent that the capability of the debris of the burned solid fuel to retain the shape similar to the original shape of the solid fuel may adversely be affected. Once the shape retention capability is adversely affected, not only does the ash component tend to adhere to the wall surface of the brazier or stove with a difficulty in removal of the completely burned solid fuel from the brazier or stove, but also the life of the brazier or stove itself will be shortened. Accordingly, in order to avoid any possible change in chemical property of these oxides and the ash component of the burned solid fuel, the use of a stable heat-resistant filler is called for.

For this purpose, the heat resistant filler which may be used in the present invention includes, for example $MgAl_2O_4$ and $ZrO_2$. These compounds are chemically stable and will not react with the ash component containing the desulfurizing agent and, therefore, the debris of the burned solid fuel can retain the shape similar to the original shape of the solid fuel.

The filler hitherto used in silica, but in the present invention, 10 parts by weight or less of silica is used relative to 100 parts by weight of the carbonaceous material. If the amount of the silica exceeds 10 parts by weight, it will react with the desulfurizing agent with the desulfurizing effect consequently reduced. Although it is desirable not to use $SiO_2$, a limited amount thereof is employed in the present invention because it is available at low cost. Not only $SiO_2$, but also a mineral containing $SiO_2$ as one of its constituents such as, for example, agalmatolite ($Al_2Si_4O_{10}(OH)_{10}$), mullite ($3Al_2O_3.2SiO_2$), feldspar and the like are compounds which will adversely affect the desulfurizing effect given by the desulfurizing agent. Accordingly, the amount of the mineral usable in the present invention is equally limited as is the case with $SiO_2$.

The heat-resistant filler usable in the present invention is selected from the group consisting of $MgAl_2O_4$ and $ZrO_2$. $MgAl_2O_4$ is also referred to as cryolite and is a mineral having a spinal structure, either occurring in nature or synthesized. Instead of employing $MgAl_2O_4$ per se, a magnesium salt or an alumina salt may be employed because it forms $MgAl_2O_4$ when heated. Compounds that form these salts include a combination of one of $MgCO_3$ and $Mg(OH)_2$ and one of $Al_2O_3$ and $Al(OH)_3$, but may not be limited thereto. $MgCO_3$ and $Al_2O_3$ may be independently used and, in such cases, reduction of the desulfurizing effect of the desulfurizing agent will take place in a manner similar to the use of $SiO_2$. However, when the both are used in combination, an effect similar to that exhibited by the use of $MgAl_2O_4$ can be obtained.

When combining the magnesium salt and the aluminum salt together, the ratio of mixing of these salts is preferably so selected that the combination corresponds stoichiometrically to $MgAl_2O_4$ for the purpose of increasing the resistance to heat, but may not be limited thereto according to the present invention. This is because, once $MgAl_2O_4$ is partially formed, the remaining MgO or $Al_2O_3$ can be restrained by a barrier of $MgAl_2O_4$ from being glassified and melted.

$ZrO_2$ is also a heat-resistant mineral comparable to $MgAl_2O_4$ and is generally used in the form of a zirconia ceramics. Although $ZrO_2$ may be used singly, since it tends to undergo a crystal modification at about 1,100° C., compounds of $ZrO_2$ which have been stabilized by the use of Ca, Y, Mg and Co are currently commercially available. All of these compounds may be utilizable in the present invention, but the compound which has been stabilized by the use of CaO is preferred because it is easily available.

The heat-resistant fillers hereinbefore discussed may be employed either singly or in combination and the amount thereof to be used should be determined in consideration of the amounts of the other additives.

If desired, clay such as, for example, bentonite may be used as a molding additive. Where this molding additive is used, the amount thereof should be 5 parts by weight or less relative to 100 parts by weight of the carbonaceous fuel material. A binding agent such as, for example, carboxymethyl-cellulose, tar, pitch, molasses, waste water resulting from the pulp manufacture and the like may also be employed in the present invention.

Hereinafter, the present invention will be illustrated by way of non-limitative examples.

EXAMPLE 1

Samples of solid fuels numbered 1 to 10 in Table 1 were prepared using 100 parts by weight of coal (Product of North Vietnam and commercially identified by Hongei No. 3), different desulfurizing agents in a respective amount specified in Table 1 relative to 100 parts by weight of the coal, and $K_2CO_3$ in a respective amount specified in Table 1 relative to 100 parts by weight of the coal, the particle size of all of these materials having been equal to or smaller than 5 mesh according to Tyler Standard Screen Scale. The samples No. 1 to No. 10 were subsequently burned to evaluate the desulfurizing effect, and the results of the tests are shown in Table 2.

Evaluation of the desulfurizing effect exhibited by the samples was carried out by burning 1 g of the respective samples placed on a ceramic port within an electric heating furnace heated to a different temperature as specified in Table 1, while oxygen was forcibly passed through the furnace at a rate of 80 cc per minute, passing the resultant exhaust gases through a both of hydrogen peroxide to cause sulfur dioxide, contained in the exhaust gases, to be absorbed thereby, and neutralizing the hydrogen peroxide by the use of a 1/20N NaOH solution to find the content of sulfur contained per unit weight of the coal. The sulfur content so determined was then compared with that which was determined by burning only the coal. The desulfurizing rate referred in Table 1 represents the percentage of reduction of the content of the sulfur emitted per unit weight of the coal when the desulfurizing agent had been used, relative to the sulfur content determined by burning only the coal.

TABLE 1

| Sample No. | Desulfurizing Agent | | | | Desulfurizing Rate (%) | | |
|---|---|---|---|---|---|---|---|
| | $Ca(OH)_2$ | $CaCO_3$ | Dolomite | $K_2CO_3$ | 800° C. | 1000° C. | 1200° C. |
| 1 | 10 | — | — | — | 89 | 75 | 50 |
| 2 | — | 10 | — | — | 75 | 64 | 42 |
| 3 | — | — | 10 | — | 81 | 52 | 37 |
| 4 | 10 | — | — | 5 | 98 | 96 | 85 |
| 5 | — | 10 | — | 5 | 98 | 96 | 86 |
| 6 | — | — | 10 | 5 | 98 | 95 | 83 |
| 7 | 5 | 5 | — | 5 | 99 | 97 | 85 |
| 8 | — | 5 | 5 | 5 | 98 | 97 | 86 |
| 9 | 5 | — | 5 | 5 | 99 | 98 | 87 |
| 10 | 5 | 5 | 5 | 5 | 98 | 98 | 87 |

As can readily seen from Table 1, the combined use of the desulfurizing agent with $K_2CO_3$ exhibits a higher desulfurizing rate than the sole use of the desulfurizing agent and that the use of any one of the compounds for the desulfurizing agent makes no significant difference.

EXAMPLE 2

In a manner similar to Example 1, but using the respective desulfurizing agent in a different amount as specified in Table 2 and $K_2CO_3$ in a different amount as specified in Table 2, similar samples numbered 1 to 20 were prepared and tested, the results being shown in Table 2. The calorie values referred to in Table 2 were determined by the use of a pump type calorimeter stipulated in JIS M8814.

From Table 2, it will readily be seen that the the employment of the desulfurizing agent in an amount equal to or greater than 3 parts by weight relative to 100 parts by weight of the carbonaceous fuel material gives favorable results and that the employment of $K_2CO_3$ in an amount equal to greater than 1 part by weight relative to 100 parts by weight of the carbonaceous fuel material gives a favorable result. Where the amount of the desulfurizing agent used is relatively great while that of $K_2CO_3$ is smaller than 1 part by weight, the desulfurizing effect decrease with increase of the heating temperature. In addition, where the amount of any one of the desulfurizing agent and $K_2CO_3$ exceeds 20 parts by weight, it has been found that, while the desulfurizing effect is acceptable, the calorie values decrease. The use of the desulfurizing agent and $K_2CO_3$ in a respective amount greater than 20 parts by weight relative to 100 parts by weight of the carbonaceous fuel material is undesirable because it renders the solid fuel expensive.

TABLE 2

| Sample No. | Desulfurizing Agent | | | | Desulfurizing Rate (%) | | | Calorie (cal/g) |
|---|---|---|---|---|---|---|---|---|
| | $Ca(OH)_2$ | $CaCO_3$ | Dolomite | $K_2CO_3$ | 800° C. | 1000° C. | 1200° C. | |
| 1 | 2 | — | — | 0.5 | 32 | 13 | 2 | 7089 |
| 2 | 2 | — | — | 5.0 | 78 | 42 | 11 | 6900 |
| 3 | 3 | — | — | 0.8 | 47 | 31 | 8 | 7042 |
| 4 | 3 | — | — | 1.0 | 79 | 57 | 49 | 7050 |
| 5 | 5 | — | — | 0.8 | 80 | 58 | 43 | 6823 |
| 6 | 5 | — | — | 1.2 | 85 | 74 | 70 | 6811 |
| 7 | 10 | — | — | 3.0 | 97 | 95 | 83 | 6705 |
| 8 | 15 | — | — | 5.0 | 98 | 97 | 87 | 6234 |
| 9 | 20 | — | — | 20 | 99 | 98 | 91 | 4520 |
| 10 | 22 | — | — | 21 | 99 | 98 | 96 | 3800 |
| 11 | 1 | 1 | — | 0.8 | 31 | 12 | 2 | 7052 |
| 12 | 2 | 1 | — | 1.0 | 78 | 56 | 50 | 7048 |
| 13 | 2 | — | 1 | 1.0 | 79 | 56 | 49 | 7054 |
| 14 | — | 5 | 5 | 2.0 | 98 | 92 | 81 | 6725 |
| 15 | 5 | 5 | 5 | 0.8 | 97 | 83 | 43 | 6607 |
| 16 | 5 | 5 | 5 | 2.0 | 98 | 93 | 82 | 6538 |
| 17 | 10 | 10 | 10 | 5.0 | 99 | 97 | 88 | 3924 |
| 18 | — | 20 | — | 1.0 | 97 | 92 | 74 | 6329 |
| 19 | — | 20 | — | 5.0 | 97 | 95 | 89 | 6114 |
| 20 | 10 | 10 | — | 20 | 99 | 98 | 97 | 4511 |

EXAMPLE 3

In a manner similar to Example 2, but using a different mixing ratio between the desulfurizing agent and $K_2CO_3$, similar samples numbered 1 to 10 were prepared and tested in a similar manner as in Example 1, the results of which are shown in Table 3.

From Table 3, it will readily be seen that, when the ratio between the desulfurizing agent and $K_2CO_3$ is within the range of 0.2 to 10.0, a relatively high desulfurizing effect can be observed. Sample No. 1 was found having swelled when allowed to stand because of the use of $K_2CO_3$ in a relatively great amount. Though the samples No. 1 and No. 2 gave no difference in desulfurizing effect, the ratio of 0.2 to 10.0 is considered advisable because of the reason stated hereinbefore.

TABLE 3

| Sample Nos. | Desulfurizing Agent | | | | Desulfurizing Agent | Desulfurizing Rate (%) | | |
|---|---|---|---|---|---|---|---|---|
| | $Ca(OH)_2$ | $CaCO_3$ | Dolomite | $K_2CO_3$ | $K_2CO_3$ | 800° C. | 1000° C. | 1200° C. |
| 1 | 3 | — | — | 20 | 0.15 | 94 | 73 | 59 |
| 2 | 3 | — | — | 15 | 0.20 | 94 | 72 | 67 |

TABLE 3-continued

| Sample Nos. | Desulfurizing Agent $Ca(OH)_2$ | $CaCO_3$ | Dolomite | $K_2CO_3$ | Desulfurizing Agent $K_2CO_3$ | Desulfurizing Rate (%) 800° C. | 1000° C. | 1200° C. |
|---|---|---|---|---|---|---|---|---|
| 3 | 3 | 2 | — | 20 | 0.25 | 97 | 87 | 81 |
| 4 | — | 5 | 5 | 20 | 0.50 | 98 | 96 | 89 |
| 5 | — | 10 | — | 10 | 1.00 | 98 | 96 | 90 |
| 6 | 5 | — | 5 | 5 | 2.00 | 98 | 93 | 88 |
| 7 | 5 | 5 | 5 | 5 | 3.00 | 99 | 97 | 91 |
| 8 | 10 | — | 10 | 5 | 4.00 | 99 | 98 | 92 |
| 9 | — | 20 | — | 2 | 10.00 | 97 | 94 | 80 |
| 10 | 20 | — | — | 1.8 | 11.1 | 98 | 70 | 61 |

EXAMPLE 4

Samples of solid fuels numbered 1 to 8 in Table 4 were prepared using the same coal as in Example 1, but having a different particle size as specified in Table 4, 12 parts by weight of the desulfurizing agent (only $CaCO_3$) relative to 100 parts by weight of the coal, but having a different particle size as specified in Table 4, and 6 parts by weight of $K_2CO_3$ relative to 100 parts by weight of the coal, for the purpose of finding how the particle size affects the desulfurizing agent.

The tests were carried out in the same manner as in Example 1, the results of which are shown in Table 4.

As can readily be understood from Table 4, where 60% or more of the total amount of the coal used is of a particle size effective to pass through the 5 mesh Tyler screen, a relatively high desulfurizing rate can be obtained. The use of the desulfurizing agent of a particle size effective to pass through the same screen is also advisable.

EXAMPLE 5

Except for different carbonaceous fuel materials, being used in a respective amount as specified in Table 5 and also except that only dolomite was used as a desulfurizing agent in an amount of 10 parts by weight relative to 100 parts by weight of each of the carbonaceous materials and that only 5 parts by weight of $K_2CO_3$ relative to the same was used, samples numbered 1 to 6 were prepared and tested in the same manner as in Example 1. The results of the tests are shown in Table 5.

TABLE 4

| Sample Nos. | Particle Size of Coal (wt %) Larger than 3 meshes | 3 to 5 meshes | Smaller than 5 meshes | Particle Size of Larger than 5 meshes | Smaller than 5 meshes | Desulfurizing Rate (%) 800° C. | 1000° C. | 1200° C. |
|---|---|---|---|---|---|---|---|---|
| 1 | 5 | 45 | 50 | — | 100 | 63 | 58 | 51 |
| 2 | 12 | 30 | 58 | — | 100 | 64 | 60 | 52 |
| 3 | 5 | 35 | 60 | — | 100 | 88 | 83 | 76 |
| 4 | 10 | 10 | 80 | — | 100 | 91 | 89 | 82 |
| 5 | — | — | 100 | — | 100 | 99 | 97 | 91 |
| 6 | — | — | 100 | 20 | 80 | 80 | 77 | 68 |
| 7 | — | — | 100 | 50 | 50 | 72 | 63 | 54 |
| 8 | — | — | 100 | 100 | — | 62 | 58 | 50 |

TABLE 5

| Sample Nos. | Carbonaceous Fuel Material (wt %) Coal | Charcoal | Cokes | Graphite | Desulfurizing Rate (%) 800° C. | 1000° C. | 1200° C. |
|---|---|---|---|---|---|---|---|
| 1 | 90 | 10 | — | — | 99 | 98 | 90 |
| 2 | 90 | — | 10 | — | 98 | 97 | 88 |
| 3 | 80 | 10 | 10 | — | 99 | 98 | 91 |
| 4 | 80 | — | 10 | 10 | 99 | 97 | 92 |
| 5 | 70 | 10 | 10 | 10 | 99 | 98 | 92 |

TABLE 5-continued

| Sample Nos. | Carbonaceous Fuel Material (wt %) Coal | Charcoal | Cokes | Graphite | Desulfurizing Rate (%) 800° C. | 1000° C. | 1200° C. |
|---|---|---|---|---|---|---|---|
| 6 | 70 | — | 25 | 5 | 99 | 98 | 91 |

EXAMPLE 6

A mixture of the following composition was, after a slight amount of water had been added thereto, molded by the use of a molding press into a cylindrical solid fuel, 116 mm in diameter and 120 mm in length, having 16 axially extending through-holes of 10 mm in diameter.

| Composition | Amount | Particle Size |
|---|---|---|
| Coal (Hongei No. 3) | 100 wt. parts | Smaller than 5 meshes |
| T - $MnO_2$ | 5 wt. parts | " |
| $CaCO_3$ | 12 wt. parts | " |
| $K_2CO_3$ | 6 wt. parts | " |
| Bentonite | 2 wt. parts | " |
| Carboxylmethyl-cellulose | 2 wt. parts | " |

The solid fuel so prepared was burned in a commercially available briquette brazier, and exhaust gases emitted therefrom were collected in a hood over-hanging the briquette brazier and examined continuously as to the amount of emission of $SO_2$ by the use of an infrared $SO_2$ measuring meter. The result of the test conducted is shown in the accompanying drawing wherein the curve A illustrates change in $SO_2$ concentration in the exhaust gases emitted from the solid fuel according to this example whereas the curve B illustrates that from a comparison solid fuel wherein no $\gamma$-$MnO_2$ was employed. As can be understood from the graph in the accompanying drawing the solid fuel according to the present invention emits a lesser amount of $SO_2$ than the comparison at the initial stage of combustion.

EXAMPLE 7

When in the composition as in Example 6 the amount of $\gamma$-$MnO_2$ used was changed to 0.8, 1, 3 and 5 parts by weight relative to 100 parts by weight of the coal, the peak values of $SO_2$ emission in these samples at the initial stage of combustion were found to be 13 ppm, 7 ppm, 4.3 ppm, 1.5 ppm and 1.4 ppm, respectively. This suggests that the minimum acceptable amount of $\gamma$-$MnO_2$ to be used is 1 part by weight relative to 100 parts of weight of the carbonaceous fuel material. In addition, although the desulfurizing rate increases with increase of the amount of $\gamma$-$MnO_2$ used, the increased amount of $\gamma$-$MnO_2$ in turn reduces the calorie value and, therefore, it is preferred that the maximum acceptable amount of $\gamma$-$MnO_2$ should not exceed 10 parts by weight relative to 100 parts by weight of the carbonaceous fuel material.

EXAMPLE 8

When in the composition as in Example 6 $\gamma$-$MnO_2$ was replaced by CuO, $Fe_2O_3$, NiO, $Cr_2O_3$ and $Co_2O_3$ one at a time, the peak values of $SO_2$ emission in these samples at the initial stage of combustion were found to be 3 ppm, 4.5 ppm, 4.7 ppm, 5.4 ppm and 3.4 ppm, respectively. The findings in Examples 6 and 8 suggest that oxides of any of manganese and copper is excellent in performance.

EXAMPLE 9

When in the composition as in Example 6 the coal was replaced by a mixture of 90 parts by weight of coal 10 parts by weight of charcoal, the peak value of $SO_2$ emission in this sample at the initial stage of combustion was found 1.2 ppm.

EXAMPLE 10

When in the composition as in Example 6 $\gamma$-$MnO_2$ was replaced by $MnCO_3$ and $CuCO_3.Cu(OH)_2$ one at a time, the peak values of $SO_2$ emission in these samples measured within an hour from the start of combustion were found 4.2 ppm and 4 ppm, respectively.

EXAMPLE 11

Using coal (Hongei No. 3 coal) as a carbonaceous fuel material and the desulfurizing, $K_2CO_3$ and heat-resistant filler in a respective amount specified in Table 6, samples of solid fuels numbered 1 to 10 were prepared and examined as to the desulfurizing effect, the results of the tests being shown in Table 6.

TABLE 6

| Sample Nos. | Type & Amount of Desulfurizing Agent (wt %) I | II | III | Type & Amount of Filler (wt %) I | II | Purification Degree (%) | Ash Condition |
|---|---|---|---|---|---|---|---|
| 1 | $Ca(OH)_2$ (10) | $K_2CO_3$ (5) | — | — | — | 98 | Not acceptable |
| 2 | $Ca(OH)_2$ (10) | $K_2CO_3$ (5) | — | $SiO_2$ (12) | — | 64 | " |
| 3 | $Ca(OH)_2$ (10) | $K_2CO_3$ (5) | — | $SiO_2$ (10) | — | 84 | Good |
| 4 | $Ca(OH)_2$ (10) | $K_2CO_3$ (5) | — | $SiO_2$ (5) | $MgAl_2O_4$ (10) | 97 | Excellent |
| 5 | $CaCO_3$ (12) | $K_2CO_3$ (5) | | $SiO_2$ (5) | $ZrO_2$ (10) | 96 | " |
| 6 | $CaCO_3$ (5) | Dolomite (10) | $K_2CO_3$ (5) | $SiO_2$ (5) | — | 83 | " |
| 7 | $Ca(OH)_2$ (10) | Dolomite (5) | $K_2CO_3$ (5) | $MgAl_2O_4$ (15) | — | 98 | " |
| 8 | $CaCO_3$ (12) | $K_2CO_3$ (6) | — | $ZrO_2$ (20) | — | 97 | " |
| 9 | $CaCO_3$ (12) | $K_2CO_3$ (6) | — | $MgCO_3$ (10) | $Al_2O_3$ (10) | 96 | " |
| 10 | $CaCO_3$ (20) | $K_2CO_3$ (3) | — | $MgAl_2O_4$ (10) | | 99 | " |

It is to be noted that all of the materials used had a particle size equal to or smaller than 5 meshes according to the Tyler Standard Screen Scale.

Evaluation of the desulfurizing effect exhibited by each of the samples in this Example was carried out by burning 1 g of each sample placed on a ceramic port under oxygen atmospher (100 cc/min) within an electric furnace heated to 1,000° C., passing the resultant exhaust gases through a bath of 1% hydrogen peroxide to cause sulfur dioxide, contained in the exhaust gases, to be absorbed thereby, and neutralizing the hudrogen peroxide by the use of a 1/20N NaOH solution to find the content of sulfur. On the other hand, having used the same procedure as described above, the content of sulfur emitted by burning only the coal was determined and was then used to calculate the theoretical content of sulfur which would have been emitted by burning the solid fuel. The difference between the measured value and the theoretical value is fixed for the particular desulfurizing agent and the percentage of the ratio of the measured value relative to the theoretical value is shown as purification degree in Table 6.

In Table 6, the legends "not acceptable", "good" and "excellent" used in the column of "Ash Condition" are respectively defined as follows.

Not Acceptable: Ash of the testpiece (1 g of each sample referred to hereinabove) adhered to the ceramic port, having completely been melted.

Good: Ash of the testpiece slightly adhered to the ceramic port, having melted.

Excellent: Ash of the testpiece did neither adhere nor melt.

In Table 6, the samples No. 1 and No. 2 are for the purpose of comparison. Although the sample 1 has exhibited a relatively high purification degree, the condition of the ash when having been burned is not acceptable. Since in the sample No. 2 more than 10 parts by weight $SiO_2$ were employed, both the purification degree and the ash condition exhibited thereby are not acceptable.

EXAMPLE 12

When in the composition of the sample No. 9 in Example 11 the heat-resistant filler $Al_2O_3$ was replaced by by $Al(OH)_3$, the purification degree was found to be 97% and the ash condition was found good.

EXAMPLE 13

When in the composition of the sample No. 4 in Example 11 the amount of $Ca(OH)_2$ was changed to 1, 2, 3, 5 and 7 parts by weight one at a time, the purification degrees were found to be 53%, 61%, 81%, 87% and 91%, respectively, and all of the ash conditions were found excellent. In view of this, it is clear that the use of 3 or more parts by weight of $Ca(OH)_2$ relative to the carbonaceous fuel material is effective.

EXAMPLE 14

When in the composition of the sample No. 4 in Example 11 the amount of $K_2CO_3$ was changed to 0.8, 1, 3, 15, 20 and 22 parts by weight one at a time, the purification degrees were found to be 51, 79, 91, 98, 99 and 99%, respectively. However, the sample wherein the amount of $K_2CO_3$ added was 22 parts by weight become swollen after the preparation thereof and the ash condition thereof was not acceptable. The other samples in this Example had an excellent ash condition. From this, it is clear that the use of $K_2CO_3$, in an amount within the range of 3 to 20 parts by weight relative to 100 parts by weight of the carbonaceous fuel material, is effective for the purpose of the present invention.

EXAMPLE 15

The sample No. 4 in Example 11 was tested as to its calorie content by the use of a calorimeter stipulated according to JIS (Japan Industrial Standards). It was found to be 6,450 kcal/kg.

Apart from the above, samples similar to the sample No. 4 in Example 11, but wherein the amount of $Ca(OH)_2$ used in the sample No. 4 was changed to 20 and 25, respectively, were also tested as to their calorie and were found to have given 5,250 and 4,750 kcal/kg, respectively. The purification degrees of these samples were found 98% and 99%, respectively, with their ash conditions good and not acceptable, respectively. Considering the reduced calorie content and the ash condition, the uppermost limit of the amount of $Ca(OH)_2$ should be 20 parts by weight relative to 100 parts by weight of the carbonaceous fuel material.

EXAMPLE 16

When in the composition of the sample No. 7 in Example 11 the carbonaceous material used therein was replaced by a mixture of 90 parts by weight of coal with 10 parts by weight of charcoal and a mixture of 90 parts by weight of coal with 10 parts by weight of cokes one at a time, the purification degrees were found to be 98% both with the ash conditions excellent.

EXAMPLE 17

When in the composition of the sample No. 5 in Example 11 $ZrO_2$ was replaced by a stabilized zirconia containing 20 moles of CaO, the purification degree was found 97% with the excellent ash condition. However, the sample in this Example was found to have a higher heat resistance than that of the sample No. 5 in Example 11.

Although the present invention has fully been described by a of example, it is to be noted that various changes and modifications are apparent to those skilled in the art. Such changes and modifications are to be construed as included within the spirit and scope of the present invention unless they depart therefrom.

We claim:

1. A molded solid fuel which comprises:

a carbonaceous fuel material;

at least one desulfurizing agent selected from the group consisting of $Ca(OH)_2$, $CaCO_3$ and dolomite, the amount of said desulfurizing agent being within the range of 3 to 20 parts by weight relative to the 100 parts by weight of the carbonaceous fuel material;

$K_2CO_3$ in an amount within the range of 1 to 20 parts by weight relative to the total amount of the carbonaceous fuel material, wherein the ratio of parts by weight of desulfurizing agent to $K_2CO_3$ is within the range of 0.2 to 10; and at least one member selected from the transition metal oxides consisting of manganese dioxide and copper oxide, the amount of said transition metal oxide being within the range of 1 to 10 parts by weight relative to 100 parts by weight of the carbonaceous fuel material.

2. The solid fuel as claimed in claim 1, wherein the carbonaceous fuel material is at least one member selected from the group consisting of coal, charcoal, cokes and graphite.

3. The solid fuel as claimed in claim 1, wherein the manganese dioxide is $\gamma$-manganese dioxide.

4. The solid fuel as claimed in claim 1 which additionally contains at least one heat-resistant filler selected from the group consisting of $MgAl_2O_4$, and $ZrO_2$; and a silica-containing compound in an amount of not more than 10 parts by weight, said parts by weight being relative to 100 parts by weight of the carbonaceous fuel material.

* * * * *